US007536121B2

(12) United States Patent
Shimizu et al.

(10) Patent No.: US 7,536,121 B2
(45) Date of Patent: May 19, 2009

(54) IMAGE FORMING APPARATUS AND IMAGE DENSITY CONTROL METHOD

(75) Inventors: Kiichirou Shimizu, Kanagawa (JP); Shinji Kato, Kanagawa (JP); Shin Hasegawa, Kanagawa (JP); Kohta Fujimori, Kanagawa (JP); Nobutaka Takeuchi, Kanagawa (JP); Yushi Hirayama, Kanagawa (JP); Kayoko Tanaka, Tokyo (JP); Takashi Enami, Kanagawa (JP); Kazumi Kobayashi, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 133 days.

(21) Appl. No.: 11/603,220

(22) Filed: Nov. 22, 2006

(65) Prior Publication Data

US 2007/0122169 A1 May 31, 2007

(30) Foreign Application Priority Data

Nov. 25, 2005 (JP) ..... 2005-341060
Oct. 19, 2006 (JP) ..... 2006-285248

(51) Int. Cl.
*G03G 15/08* (2006.01)

(52) U.S. Cl. ..... 399/27; 399/30; 399/59

(58) Field of Classification Search ..... 399/59, 399/27, 30, 58, 61, 62; 358/406, 504; 347/19
See application file for complete search history.

(56) References Cited

U.S. PATENT DOCUMENTS

| | | | | |
|---|---|---|---|---|
| 5,579,091 | A * | 11/1996 | Yamada et al. | 399/59 |
| 5,826,136 | A * | 10/1998 | Saiko et al. | 399/58 X |
| 6,006,050 | A * | 12/1999 | Watanabe et al. | 399/58 |
| 6,118,953 | A * | 9/2000 | Hockey et al. | 399/59 |
| 6,141,509 | A * | 10/2000 | Karasawa | 399/58 |
| 6,501,916 | B2 * | 12/2002 | Suzuki | 399/30 |
| 2006/0127109 | A1 * | 6/2006 | Itoyama et al. | 399/27 |
| 2006/0239701 | A1 * | 10/2006 | Ishibashi | 399/30 |
| 2007/0116480 | A1 * | 5/2007 | Takeuchi et al. | 399/27 |

FOREIGN PATENT DOCUMENTS

| | | |
|---|---|---|
| JP | 57-136667 | 8/1982 |
| JP | 02-034877 | 2/1990 |
| JP | 07-234582 | 9/1995 |
| JP | 10-186830 | 7/1998 |
| JP | 2001-281979 | 10/2001 |
| JP | 2003-057939 | 2/2003 |

* cited by examiner

*Primary Examiner*—Sophia S Chen
(74) *Attorney, Agent, or Firm*—Harness Dickey & Pierce PLC

(57) ABSTRACT

An image forming apparatus is configured that a developing unit develops a latent image with a toner, which is controlled by a toner-supply control unit based on a deference between a toner-density of the toner that is supplied to the developing unit and a reference-value. A reference-value determining unit determines the reference-value. A condition determining unit determines whether a predetermined condition is satisfied. The reference-value determining unit updates the reference-value with a different reference-value when the condition determining unit determines that the predetermined condition is satisfied.

17 Claims, 4 Drawing Sheets

IMAGE FORMING APPARATUS AND IMAGE DENSITY CONTROL METHOD

CROSS-REFERENCE TO RELATED APPLICATIONS

The present document incorporates by reference the entire contents of Japanese priority documents, 2005-341060 filed in Japan on Nov. 25, 2005 and 2006-285248 filed in Japan on Oct. 19, 2006.

BACKGROUND OF THE INVENTION

1. Field of the Invention

The present invention generally relates to an image forming apparatus, and specifically to an image density control method for the image forming apparatus.

2. Description of the Related Art In recent years, high image quality has been required for image forming apparatuses such as copiers and laser printers. High durability and high stability of images have been also desired. In other words, the images that are formed thereby have to be stably provided at any time even upon the passage of time by minimizing changes in the image quality due to changes in the use environment including continuous printing and intermittent printing.

Has been known a two-component developing method for carrying a two-component developer (hereinafter, "developer") containing non-magnetic toner (hereinafter, "toner") and magnetic carrier (hereinafter, "carrier") on a developer carrying element (hereinafter, "developing sleeve"), which causes a magnetic pole provided therein to form a magnetic brush, and for applying a developing bias to the developing sleeve at a position where a latent image carrier (hereinafter, "photoconductor") faces the developing sleeve, so as to perform development. The two-component developing method is now widely used because of easy colorization.

In this method, the developer is conveyed to a developing region following a rotation of the developing sleeve. A large number of carrier in the developer aggregate with toner along a magnetic line of a developing pole as the developer is conveyed to the developing region, to form the magnetic brush. The two-component developing method is different from a one-component developing method. In other words, to improve the stability, it is extremely important for the two-component developing method to precisely control a weight ratio, or toner density, between the toner and the carrier.

For example, if the toner density is too high, smudges may appear on the background of an image or a resolution may be reduced. If the toner density is low, the density of a solid image area may be reduced or the carrier may be deposited thereto. Therefore, it is necessary to control the amount of toner supply to adjust the toner density of the developer so as to fall within an appropriate range.

The toner density control is implemented by comparing an output value of a toner-density detector, e.g., permeability sensor, with a control reference value of the toner density to acquire a difference, calculating the amount of toner supply from an calculation equation according to the difference, and supplying toner to a developing device by a toner supply device.

A method of detecting toner density generally uses a permeability sensor. The embodiment of the present invention explained later also employs this sensor. In this method, the change in permeability of a developer due to change in toner density is converted to the change in the toner density.

Another method of detecting toner density uses an optical sensor. This method is implemented by forming a reference patch, which is a pattern, on an image carrier or an intermediate transfer belt and emitting light from a light emitting diode (LED) to the reference patch so as to detect the light that is reflected from the pattern, including specular reflected light or diffuse reflected light, by the optical sensor, e.g., photodiode or phototransistor, and detecting toner density that is amount of toner deposition based on the result of detection.

Has been also known a density control method of forming a reference toner pattern between transfer papers even during printing, during time or distance from end of last image formation to start of current image formation, and of successively controlling a control reference value for toner density of a permeability sensor.

For example, Japanese Patent Application Laid-Open (JP-A) No. S57-136667 and JP-A No. H02-34877 disclose a method of forming a toner pattern in a non-image area, detecting the density of the toner pattern and toner density in a developing device by a unit, and changing a control target value for the toner density in the developing device according to the density of the toner pattern, to maintain image density.

However, many users desire to reduce excessive toner consumption due to actual formation of the toner pattern between sheets of paper as low as possible. Correction based on the formation of the reference toner pattern between the sheets of paper tends to be implemented by increasing an interval of formation of toner patterns, or the toner pattern tends not to be formed. When the toner pattern is formed on the intermediate transfer belt and if a secondary transfer roller is not separated therefrom in each image formation, a toner cleaning device also needs to be provided to clean off the toner of the patch between the sheets adhered to the secondary transfer roller. Furthermore, when the secondary transfer roller is separated in each image formation or in each several image formations, a cleaning device does not need to be provided, but a mechanical mechanism as explained below needs to be provided. The mechanism is required to stand up to contact/separation of the secondary transfer roller with/from the intermediate transfer belt, which frequently occurs.

It is also needed to avoid forming the toner patterns between the sheets of paper in terms of mechanical cost reduction. Japanese Patent No. 3410198 discloses a method of correcting fluctuation in output of a toner density sensor due to change in the state of developer flow according to a period of time for stirring, when toner supply is controlled using the toner density sensor, and of stably maintaining the toner density.

JP-A No. 2001-281979 provides an image forming apparatus that includes a detector for detecting toner density and pattern density, image density, and also includes a unit for further lowering a lower limit when a detected value of the pattern density is a predetermined value or more even if the lower limit is set in a control reference value. However, even if the toner density is kept to a fixed value but if the developing capability of the developer is not stable, the image density is difficult to maintain only by keeping the sensor output to the fixed value.

A number of recently available image forming apparatuses adopt a technique of reducing stress into a developing apparatus. This technique is thought extremely effective in balancing the reduction in the amount of developer and the increase in life of the developer, which have conflicting purposes and are required for downsizing the developing apparatuses.

For example, in a two-component color image forming apparatus, to improve toner dispersion, additives such as silica ($SiO_2$) and titanium oxide ($TiO_2$) are externally added to a large part of toner surface. But these additives are very sensitive to mechanical stress and thermal stress. Therefore, some of the additives are sometimes buried inside the toner or depart from the surface thereof during stirring in the developing device. These phenomena change the flow property and the chargeability of the developer of which a developer including toner and carrier has, and further change physical adhesion between the toner and carrier to change, but the technique of reducing the stress can suppress these phenomena as much as possible.

On the other hand, the reduction of the stress in the developing device may sometimes cause toner chargeability, which is the capability of the developing device to charge toner, to decrease. This phenomenon is explained below. For example, when an image with a low image area ratio, which is small amount of toner replacement per unit time or per unit number of copies, is output, developing capability, that is slope of a graph in which a developing amount of toner is plotted with respect to developing bias, is kept constant. Conversely, when an image with a high image area ratio, which is large amount of toner replacement per unit time or per unit number of copies, is output, the developing capability increases. In other words, a difference in the developing capabilities is caused depending on how much of the toner is replaced in the developer. Because the replacement of the toner causes the difference in the developing capability even if the toner density is the same as each other, the control reference value for toner density has to be changed to keep constant the developing capability upon the passage of time.

Based on the consideration of the properties of the toner, if the former art of controlling is not used, that is, if the complex control, which is performed by the photosensor and the permeability sensor to correct a control reference value for image density by forming toner patches between sheets of paper, is not used, the toner density control by the permeability sensor alone is required to be more accurately performed upon continuous printing and upon changing image mode. Therefore, it is necessary to adopt a method of image density control instead of the former techniques of a complex control.

SUMMARY OF THE INVENTION

It is an object of the present invention to at least partially solve the problems in the former art.

According to an aspect of the present invention, an image forming apparatus includes an image carrier that carries thereon an electrostatic latent image; a developing unit that develops the latent image by using toner that is included in a developer that includes magnetic toner-carrier; a toner supply unit that supplies the toner to the developing unit; a toner-density detector that detects toner-density in the developer supplied to the developing unit; a reference-value determining unit that determines a reference-value that is a density reference of the toner in the developer; a toner-supply control unit that controls a toner that is supplied to the developing unit based on a difference between the toner-density detected by the toner-density detector and the reference-value; and a condition determining unit that determines whether a predetermined condition is satisfied, wherein the reference-value determining unit updates the reference-value with another reference-value when the condition determining unit determines that the condition is satisfied.

According to another aspect of the present invention, an image forming method of an image forming apparatus that includes a developing unit that develops a latent image that is formed on an image-carrier by using toner that is included in a developer that includes toner-carrier, and a toner supply unit that supplies the toner to the developing unit includes detecting toner-density in the developer supplied to the developing unit; determining a reference-value that is a reference density of the toner in the developer; controlling a toner that is supplied to the developing unit based on a difference between the toner-density detected at the detecting and the reference-value determined at the determining a reference-value; second determining whether a predetermined condition is satisfied; and updating the reference-value with another reference-value when it is determined at the second determining that the condition is satisfied.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
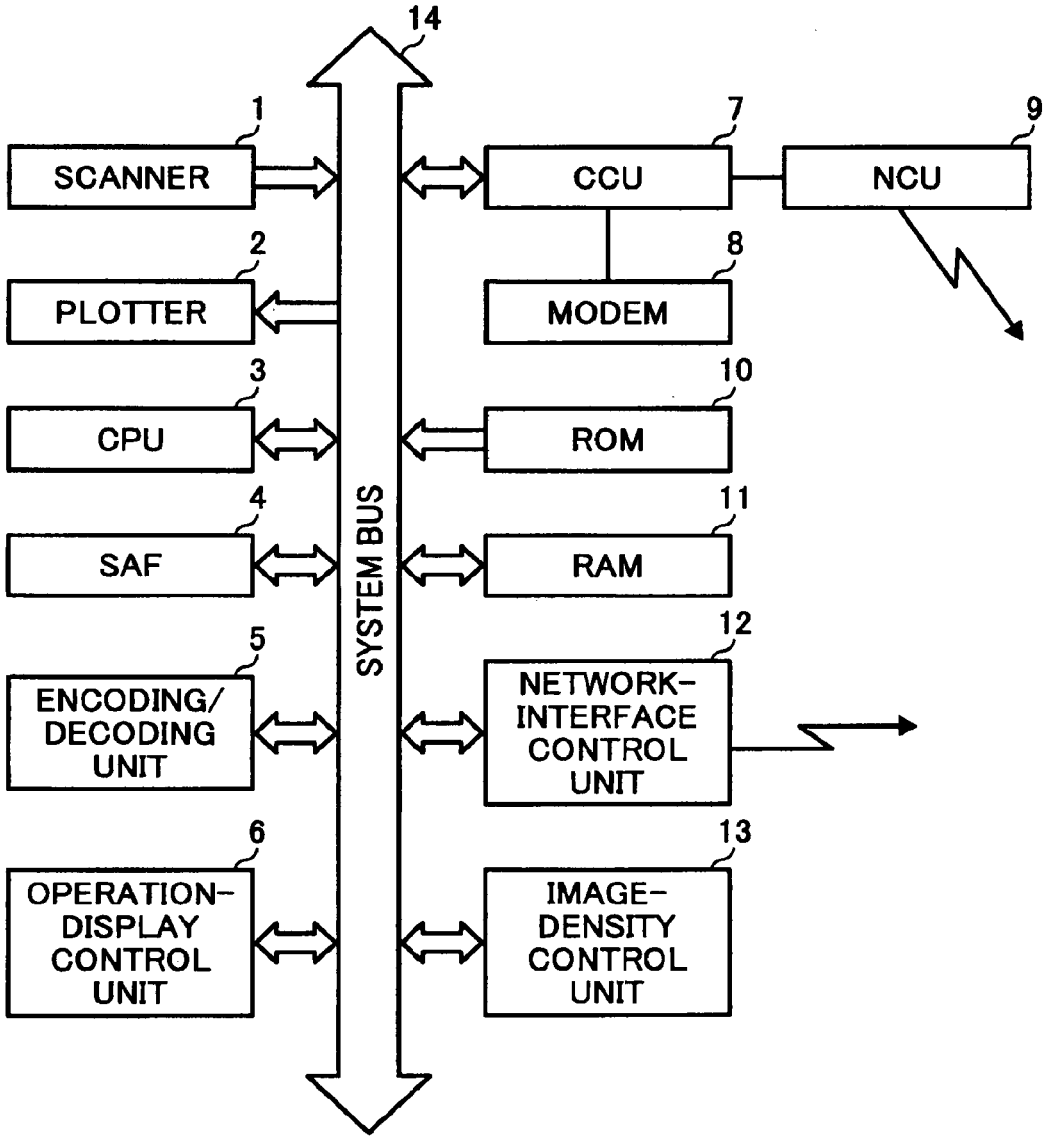
FIG. 1 is a block diagram of an image forming apparatus according to an embodiment of the present invention.

FIG. 1 is a block diagram of an image forming apparatus according to an embodiment of the present invention. The image forming apparatus according to the embodiment includes a scanner 1, a plotter 2, a Central Processing Unit (CPU) 3, a Store And Forward (SAF) 4, an encoding/decoding unit 5, an operation-display control unit 6, a Communication Control Unit (CCU) 7, a modem 8, a Network Control Unit (NCU) 9, a Read Only Memory (ROM) 10, a Random Access Memory (RAM) 11, a network-interface control unit 12, an image-density control unit 13, and a system bus 14. The components which are explained later mutually communicate with one another through the system bus 14.

The ROM 10 stores therein a basic processing program of the image forming apparatus, a control processing program for toner density explained later, and various types of data and system data required for executing the programs. The RAM 11 has a work area and stores therein various types of data required for control of the image forming apparatus. The SAF 4 is SAF memory for storing therein images.

The CPU 3 uses the RAM 11 as the work area based on the programs in the ROM 10, and also controls the components of the image forming apparatus and performs a basic operation of the image forming apparatus and a toner density control operation.

The scanner 1 is an image scanner using, for example, a Charge-Coupled Device (CCD), and operates under the control of the CPU 3 and scans a document to read an image of the document with predetermined resolution.

The plotter 2 is, for example, an electrophotographic recording device, and records and outputs an image on a paper based on image data received by a facsimile operation of the image forming apparatus and on image data of the document read by the scanner 1.

The encoding/decoding unit 5 improves efficiency of storage of the image data in image memory, which is not shown, and reduces time for transmission, and encodes the image data according to a predetermined encoding system or decodes the image data encoded.

The operation-display control unit 6 is connected with an operation display unit which is not shown. The operation display unit includes various types of operation keys such as a ten-digit keypad and a start key, and also includes a display such as a liquid crystal display. The operation-display control unit 6 informs the CPU 3 of the content of operation entered through the operation keys of the operation display unit, and displays the display data from the CPU 3 on the display of the operation display unit.

The CCU 7 is a so-called communication controller, and is connected with the NCU 9 and the modem 8. The NCU 9 is a so-called network controller, and is connected with lines such as a public line and a dedicated line. The CCU 7 exchanges facsimile control signals with an image forming apparatus as the other party, and executes facsimile communication procedures.

The modem 8 modulates a transmission signal and demodulates a received signal. The NCU 9 answers incoming calls automatically through the line, and performs an automatic calling process for the line.

The network-interface control unit 12 is connected with a predetermined network such as a Local Area Network (LAN) connected to an information terminal such as a computer, and exchanges various types of information with the information terminal connected via the network under the control of the CPU 3.

The image-density control unit 13 executes toner density control under a control of the CPU 3 when a value outside the range of the limit value initially set is updated as a new limit value.

Figure 2:
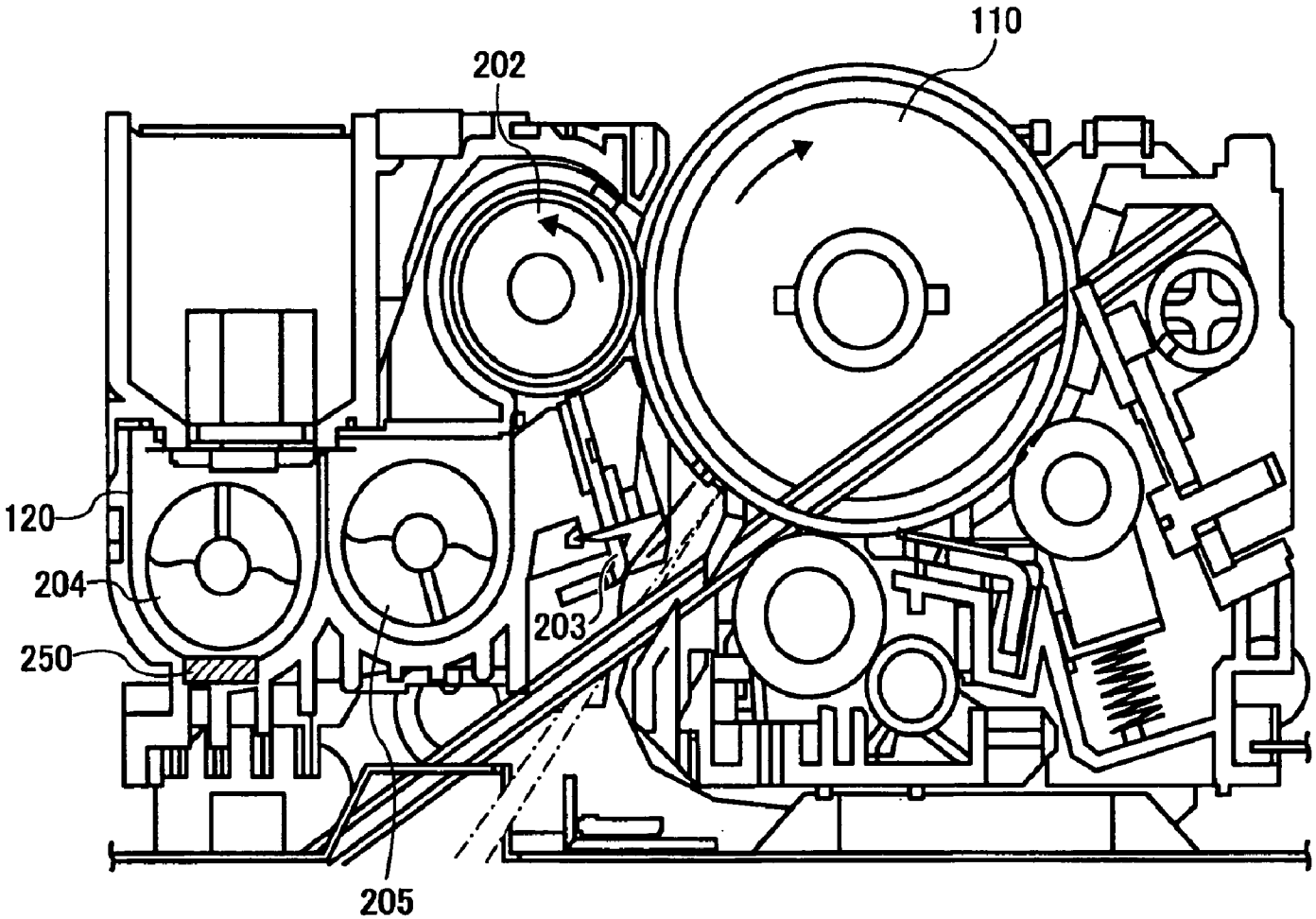
FIG. 2 is a schematic cross-section of the image forming apparatus according to the embodiment.

FIG. 2 is a schematic cross-section of the image forming apparatus according to the embodiment, and shows around a developing unit and a photoconductor unit. The developing unit includes a developing device 120, a developing sleeve 202, a doctor 203, which is a developer control member, and conveyor screw units 204 and 205.

The developing sleeve 202 serves as a developer carrying element. The conveyor screw units 204 and 205 are provided in the developing device 120, and stir the developer that contains the toner and carrier to be conveyed. The doctor 203 controls the developer that is carried on the developing sleeve 202 to a fixed amount.

The operation of the developing unit and the flow of toner are explained in detail below. First, the developer in the developing device 120 is stirred and conveyed by the conveyor screw units 204 and 205, and is carried on the developing sleeve 202 by an attracting magnetic pole thereof. Then, the developer carried on the developing sleeve 202 is conveyed near the doctor 203 by a magnetic field of a conveying pole and a frictional force of the surface of the developing sleeve 202 in association with rotation of the developing sleeve 202.

The developer conveyed near the doctor 203 temporarily stays at the upstream of the doctor 203, and is conveyed to a developing region by controlling the layer thickness of the developer with a gap between an edge of the doctor 203 and the developing sleeve 202. The developing region is applied with a predetermined developing bias to produce a developing electric field in a direction in which the toner is biased to an electrostatic latent image formed on a photoconductor 110, and the toner is thereby developed on the photoconductor 110.

The developer having passed through the developing region separates from the developing sleeve 202 at a position of a developer releasing pole on the developing sleeve 202, to be sent to the conveyor screw unit 205. Thereafter, the developer is moved to the conveyor screw unit 204, supplied with toner in a toner supply unit, and controlled to appropriate toner density, to be again conveyed to the developing sleeve 202. The flow explained above is repeated.

A permeability sensor 250 is disposed at the bottom of a casing of the developing device 120, and detects the toner density in the developer.

Figure 3:
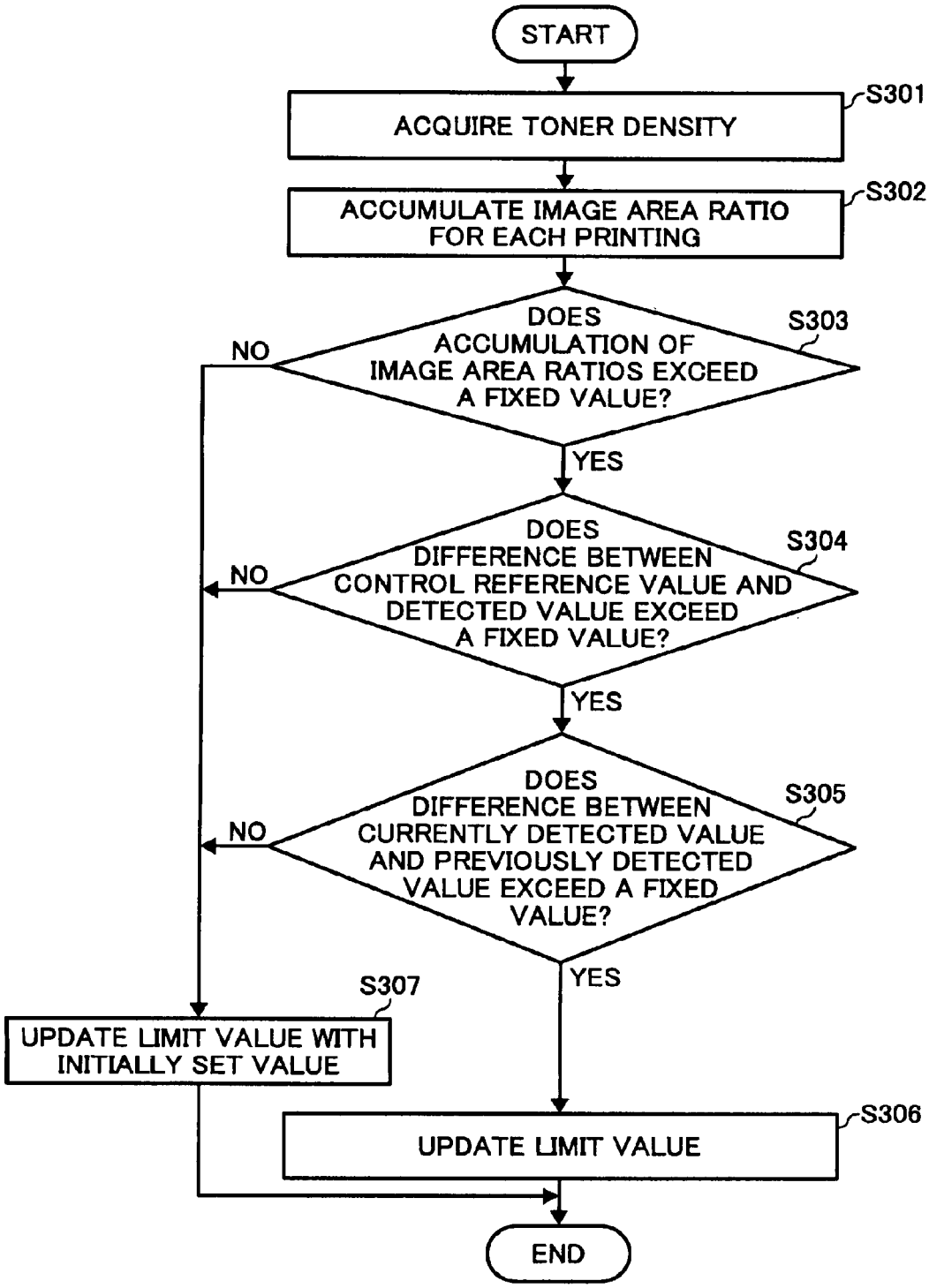
FIG. 3 is a flowchart of a toner density control operation according to the embodiment.

The toner density control that is performed by the image forming apparatus according to the embodiment is explained below. FIG. 3 is a flowchart of a toner density control operation according to the embodiment.

First, when the process is started to start printing, the image-density control unit 13 acquires toner density (step S301). The toner density is acquired by detecting toner density in the developer by, for example, the permeability sensor. The sensor for detecting the toner density can detect the toner density not only after an image forming operation is suspended but also during the image forming operation. Even when the operation is going on, the sensor can detect the toner density in each formation of a one-page image.

Then, the image-density control unit 13 calculates an image area ratio based on an image that is printed and a sheet of paper that is used for printing, and accumulates data for an image area for each printing (step S302). The image area ratio is calculated by [image area]/[traveling area]. The image area is the area of an image that is developed by a developing apparatus to be formed on a photoconductor, and the image area is calculated by [number of pixels counted]×[area of one pixel]. The number of pixels that is counted is obtained by counting the number of written pixels, and because the area of one pixel is previously determined, the image area can thereby be known.

The traveling area is acquired by a traveling distance of the photoconductor based on an image that is formed thereon and a width in which an image can be formed (hereinafter, "image formable width") on the photoconductor, and the traveling area is calculated by [traveling distance]×[image formable width]. Here, because the image formable width is previously determined, the traveling area can be known by acquiring the traveling distance.

The traveling distance is calculated by [number of rotations of photoconductor counted]×[circumferential length of photoconductor] or calculated by [time for rotations of photoconductor counted]×[linear velocity of photoconductor]. Here, because the circumferential length and the linear velocity of the photoconductor are previously determined, the traveling distance can be known by counting the number of rotations or the time for rotations. The image area ratio and the image area are calculated in these manners.

Next, the image-density control unit 13 determines whether an accumulation of the image area ratios acquired by the calculation exceeds a fixed value (step S303). When it is determined that the accumulation of the image area ratios exceeds the fixed value (step S303, YES), this can be regarded as that the amount of toner usage with respect to the sheet exceeds a predetermined level, and hence, the toner usage can be estimated.

After it is determined that the accumulation of the image area ratios exceeds the fixed value, the image-density control unit 13 determines whether a difference between a control reference value for toner density and a toner-density detected value exceeds a fixed value (step S304). When it is determined that the difference therebetween exceeds the fixed value (step S304, YES), this can be regarded as that the difference exceeds an appropriate reference value of a mixed ratio between the toner and the carrier.

Then, when the difference exceeds the fixed value (step S304, YES), the image-density control unit 13 compares a previously detected value, i.e., the toner-density detected value of the previous page with the toner-density detected value of the current page, to determine whether a difference between these detected values exceeds a fixed value (step S305).

When it is determined that the difference exceeds the fixed value (step S305, YES), the image-density control unit 13 updates the limit value that is used for calculating the control reference value for toner density (step S306). In other words, the update is performed by correcting the limit value to a value outside the range of the limit value that is initially set.

On the other hand, when any one of the three conditions is not satisfied (step S303, NO; step S304, NO; step S305, NO), the limit value is returned to a normal value, i.e., the limit value that is initially set, or the limit value that is previously set to be updated when the limit value is updated to the value outside the range of the limit value(step S307).

After updating the limit value is determined in the above manner, the process is ended, and the control reference value for toner density is re-calculated. However, when the limit value is corrected to the value outside the range initially set and updated as a limit value, a value exceeding the normal value may sometimes be calculated. By targeting this value to supply the toner during printing, the image density can be recovered. For updating the limit value, by providing a range where update is possible, the update can also be controlled within the update possible range.

The control reference value for toner density mentioned here is calculated using a characteristic value of a toner-density detection sensor, the amount of change required for reaching the reference value from the current toner density, and a coefficient based on the result of experiment. The value updated in the manner mentioned above is determined as the maximum value or the minimum value.

In the embodiment, by updating the limit value, the range of a possible value of a target control reference value for toner density can be increased. Therefore, even in the case where the recovery is used to be impossible in the former art, the image density can be recovered. When the image density becomes extremely low, it is considered that the adhesion strength of toner to carrier is increased due to degradation of the toner. When the image density exceeds an optimal threshold due to the original physical characteristic of the toner, it is considered that toner scatter may occur. However, when the image density exceeds the limit value for a certain period under specific situations such as the above case, the recovery of the image density can sometimes be expected more than the case where it does not.

In the embodiment, by containing history of image formation in determination criteria, conditions on update of the limit value can be strictly set.

In the embodiment, it is possible to obtain a value with which the limit value may be updated, the value being determined based on the difference between the toner-density detected value and the control reference value for the toner density.

In the embodiment, the limit value can be updated allowing for the change in the toner density detected.

In the embodiment, the update of the limit value may bring risks in an image, which may be in the abnormal state, but a combination of a plurality of conditions enables safety and reliable recovery of the image.

In the embodiment, by returning the limit value to the normal value before any failure occurs caused by the update of the limit value, the image can be stably output.

In the embodiment, when a value that is thought originally necessary as the control reference value for toner density is calculated, this value can be suppressed to a range where the image is stably output.

In the embodiment, the image can be recovered by a value detected during printing without suspending the printing to control the image, and an optimal image can thereby be obtained for each one of the images output.

The above-mentioned effect is explained below with reference to FIG. 4. A lower graph 402 shown in FIG. 4 indicates a case where an image with an image area ratio of 0.1% is continuously output and then an image with an image area ratio of 5% is output. In the lower graph 402, the image density is gradually recovered from a low position as the number of copies is increased, and even after switching to using the 5%-image, the target density is stably maintained.

Figure 4:
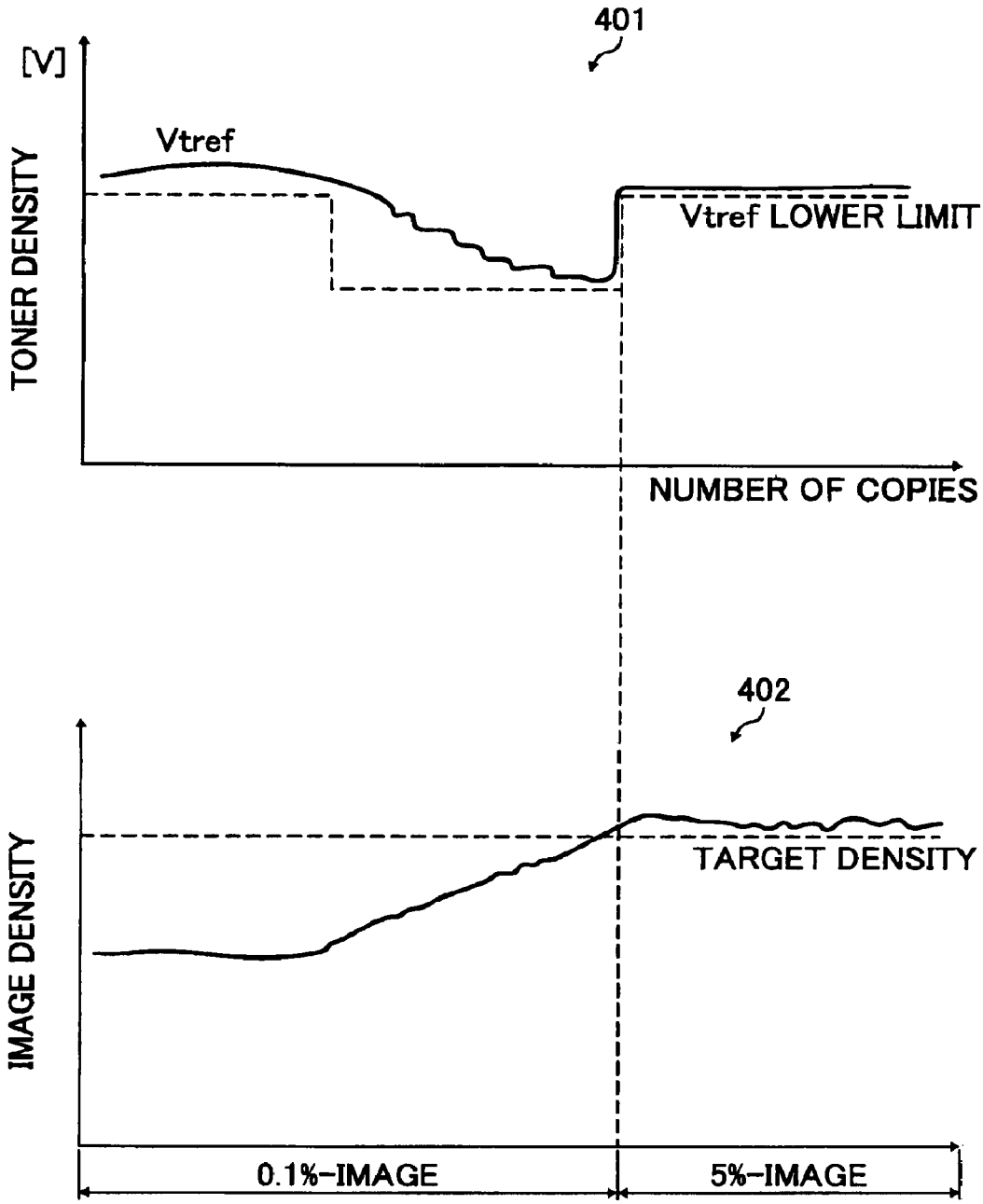
FIG. 4 is graphs of a relationship between Vtref lower limit of toner density and change in image density.

As shown in an upper graph 401 in FIG. 4, the toner density is expressed as Vtref and the limit value is expressed as Vtref lower limit. When the 0.1%-image is continuously used in the lower graph 402, and referring to the corresponding part of the upper graph 401, Vtref is following the Vtref lower limit. Despite this fact, it is apparent that the image density does not reach a target one in the lower graph 402.

When the Vtref lower limit is updated based on the determination, Vtref follows the Vtref lower limit updated and exceeds the previous limit value. Referring here to the lower graph 402, it is clear that the image density is approaching the target one.

Furthermore, it is obvious that when the image is changed to the 5%-image, the target density is maintained in the lower graph 402 by returning the Vtref lower limit in the upper graph to the original value.

In the embodiment, the value itself used to update the limit value can be controlled, which enables setting of a value that matches the characteristic of each image forming apparatus.

The embodiment is one of the exemplary embodiments of the present invention. The present invention is not therefore limited only by the embodiment, and various changes may be made without departing from the scope of the present invention.

According to the embodiment of the present invention, the image forming apparatus can be implemented. The image forming apparatus is capable of more accurate toner density control even when the toner density is detected only by a permeability sensor without using a photosensor that detects the image density, and capable of more flexible toner density control based on an appropriate control reference value, to keep constant the developing capability of the toner even upon the passage of time.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image carrier that carries thereon an electrostatic latent image;

a developing unit that develops the latent image by using toner that is included in a developer that includes magnetic toner-carrier;

a toner supply unit that supplies the toner to the developing unit;

a toner-density detector that detects toner-density in the developer supplied to the developing unit;

a reference-value determining unit that determines a reference-value that is a density reference of the toner in the developer;

a toner-supply control unit that controls a toner that is supplied to the developing unit based on a difference between the toner-density detected by the toner-density detector and the reference-value;

a ratio-calculating unit that calculates a ratio of a total area of images to a total area of recording medium; and a condition determining unit that determines whether a predetermined condition is satisfied, wherein the reference-value determining unit updates the reference-value with another reference-value when the condition determining unit determines that the condition is satisfied, and the toner-density detector detects the toner-density while the toner supply unit supplies the toner to the developing unit.

2. The image forming apparatus according to claim 1, further comprising:

an image forming unit that forms a latent image on the image carrier;

a transferring unit that transfers the latent image from the image carrier to a recording medium; and a total-area calculating unit that calculates the total area of images that are transferred to the recording medium, and calculates the total area of recording medium on which images of the total area are transferred, wherein the condition determining unit determines whether the ratio is larger than a predetermined value as the condition.

3. The image forming apparatus according to claim 2, wherein the reference-value determining unit updates a current reference-value with a previously determined reference-value when the condition determining unit determines that the condition is not satisfied.

4. The image forming apparatus according to claim 2, wherein the toner-density detector detects the toner-density when the transferring unit transfers the latent image from the image carrier to each one-sheet of recording medium.

5. The image forming apparatus according to claim 1, wherein the condition determining unit determines whether the difference between the detected toner-density and the reference-value is larger than a predetermined value as the condition.

6. The image forming apparatus according to claim 5, wherein the reference-value determining unit updates a current reference-value with a previously determined reference-value when the condition determining unit determines that the condition is not satisfied.

7. The image forming apparatus according to claim 1, wherein the condition determining unit determines whether a difference between a toner-density that is currently detected and a toner-density that is previously detected is larger than a predetermined value as the condition.

8. The image forming apparatus according to claim 7, wherein the reference-value determining unit updates a current reference-value with a previously determined reference-value when the condition determining unit determines that the condition is not satisfied.

9. The image forming apparatus according to claim 1, wherein the reference-value determining unit updates the reference-value with another reference-value, the another reference-value being inside of a range between a minimum reference-value and a maximum reference value that are defined by a current one and previously determined ones.

10. An image forming method of an image forming apparatus that includes a developing unit that develops a latent image that is formed on an image-carrier by using toner that is included in a developer that includes toner-carrier, and a toner supply unit that supplies the toner to the developing unit, the method comprising:

detecting toner-density in the developer supplied to the developing unit;

determining a reference-value that is a reference density of the toner in the developer;

controlling a toner that is supplied to the developing unit based on a difference between the toner-density detected at the detecting and the reference-value determined at the determining a reference value;

second determining whether a predetermined condition is satisfied, the second determining includes determining whether a ratio of a total area of formed images to a total area of recording sheets that are used in image-forming is larger than a predetermined value; and updating the reference-value with another reference-value when it is determined at the second determining that the condition is satisfied, wherein the toner-density detector detects the toner-density while the toner supply unit supplies the toner to the developing unit.

11. The method according to claim 10, wherein the second determining includes determining whether the difference between a toner-density that is detected at the detecting and the reference-value is larger than a predetermined value.

12. The method according to claim 11, wherein the updating the reference-value includes updating the reference-value with a previously determined reference-value that is determined at the determining when it is determined at the second determining that the condition is not satisfied.

13. The method according to claim 10, wherein the second determining includes determining whether a difference between a toner-density that is currently detected at the detecting and a toner-density that is previously detected at the detecting is larger than a predetermined value.

14. The method according to claim 13, wherein the updating the reference-value includes updating the reference-value with a previously determined reference-value at the determining when it is determined at the second determining that the condition is not satisfied.

15. The method according to claim 10, wherein the updating includes updating the reference-value with a previously determined reference-value that is determined at the determining when it is determined at the second determining that the condition is not satisfied.

16. The method according to claim 10, wherein the updating includes updating the reference-value with a reference-value that is inside of a range between a minimum reference-value and a maximum reference value that are defined by a current on and previously determined ones at the determining.

17. The method according to claim 10, wherein the detecting a toner-density includes detecting the toner-density each time when the developing unit develops one-page of the latent image.

* * * * *